US010991237B1

(12) United States Patent
Sute et al.

(10) Patent No.: US 10,991,237 B1
(45) Date of Patent: Apr. 27, 2021

(54) KEY FOB ACTUATOR HOUSING

(71) Applicant: DENSO International America, Inc., Southfield, MI (US)

(72) Inventors: Steven Sute, Dearborn, MI (US); Matthew Buchanan, Royal Oak, MI (US); Blaise Friery, West Bloomfield, MI (US); Mouhamad Bseileh, Dearborn Heights, MI (US); Jeremy T. Koscielny, South Lyon, MI (US)

(73) Assignee: DENSO INTERNATIONAL AMERICA, INC., Southfield, MI (US)

( * ) Notice: Subject to any disclaimer, the term of this patent is extended or adjusted under 35 U.S.C. 154(b) by 0 days.

(21) Appl. No.: 16/716,010

(22) Filed: Dec. 16, 2019

(51) Int. Cl.
*G08C 17/00* (2006.01)

(52) U.S. Cl.
CPC ..... *G08C 17/00* (2013.01); *G08C 2201/93* (2013.01)

(58) Field of Classification Search
CPC ..... G08C 17/00; G08C 2201/93; G05G 7/10; G07C 9/00944; G06F 17/30241; G06F 3/016; G01S 13/46
USPC ..... 340/12.5
See application file for complete search history.

(56) References Cited

U.S. PATENT DOCUMENTS

| | | | | |
|---|---|---|---|---|
| 9,576,414 | B2 * | 2/2017 | Tieman | G06F 9/451 |
| 2009/0108989 | A1 * | 4/2009 | Sinclair | B60R 25/24 340/5.62 |
| 2020/0257330 | A1 * | 8/2020 | Tieman | B60R 25/209 |

* cited by examiner

*Primary Examiner* — Vernal U Brown
(74) *Attorney, Agent, or Firm* — Brooks Kushman P.C.

(57) ABSTRACT

A key fob actuator housing and associated system is disclosed for controlling a vehicle key fob via a mobile device. The key fob actuator housing has a set of actuators configured to selectively actuate one or more first buttons of a first key fob and one or more second buttons of a second buttons of a second key fob different than the first key fob buttons. The set of actuators can have a first subset of actuators configured to selectively actuate the one or more first buttons of the first key fob, and a second subset of actuators configured to selectively actuate the one or more second buttons of the second key fob. The subsets can be programmed via a mobile device, and the housing can have a receiver and controller for communicating with the mobile device and activating corresponding actuators to press the corresponding buttons on the key fob.

20 Claims, 11 Drawing Sheets

KEY FOB ACTUATOR HOUSING

TECHNICAL FIELD

The present disclosure relates to a housing for a vehicle key fob, wherein the housing has wireless communication capabilities with a mobile device.

BACKGROUND

Remote keyless systems for vehicles are known. For example, key fobs may wirelessly communicate with the vehicle. A user can depress a button on the key fob to command various functions, such as lock the vehicle doors, unlock the vehicle doors, start the engine, etc. Recently, these functions are also available on a mobile device. For example, the owner of the vehicle may have a mobile device keyed to the controls of the vehicle; the owner can command similar functions (e.g., lock doors, unlock doors, start engine) on the owner's mobile device.

SUMMARY

According to one embodiment, a system for enabling control of a vehicle key fob via a mobile device is provided. The system includes a key fob actuator housing having a set of actuators configured to selectively actuate one or more first buttons of a first key fob that has a first button configuration and one or more second buttons of a second key fob that has a second button configuration different than the first button configuration. The set of actuators have a first subset of actuators configured to selectively actuate the one or more first buttons of the first key fob, and a second subset of actuators configured to selectively actuate the one or more second buttons of the second key fob. A receiver is configured to receive a signal from a mobile device containing information related to a desired function of the vehicle. A controller is coupled to the receiver and programmed to command one of the actuators within the first subset of actuators to actuate one of the one or more first buttons based on the information related to the desired function.

In an embodiment, a key fob actuator housing for a vehicle is provided. The key fob actuator housing includes an interior configured to receive one of a first key fob having a first plurality of buttons in a first button layout, and a second key fob having a second plurality of buttons in a second button layout. The key fob actuator housing includes a first plurality of actuators associated with the first plurality of buttons, and a second plurality of actuators associated with the second plurality of buttons. The key fob actuator housing includes a receiver configured to receive a signal from a mobile device containing information related to a desired function of the vehicle. The key fob actuator housing includes a controller coupled to the receiver and programmed to (i) command one of the first plurality of actuators to actuate one of the first plurality of buttons based on the information related to the desired function, and (ii) command one of the second plurality of actuators to actuate one of the second plurality of buttons based on the information related to the desired function.

In an embodiment, a method of controlling of a vehicle key fob via a mobile device is provided. The method includes (i): receiving information regarding a layout of a plurality of buttons of a key fob of a vehicle, (ii) receiving a signal from a mobile device containing information related to a desired function of a vehicle, and (iii) selecting one of a plurality of actuators for actuation of one of the plurality of buttons of the key fob, wherein the selecting is based on the layout of the plurality of buttons and the information related to the desired function of the vehicle.

DETAILED DESCRIPTION

Figure 1:
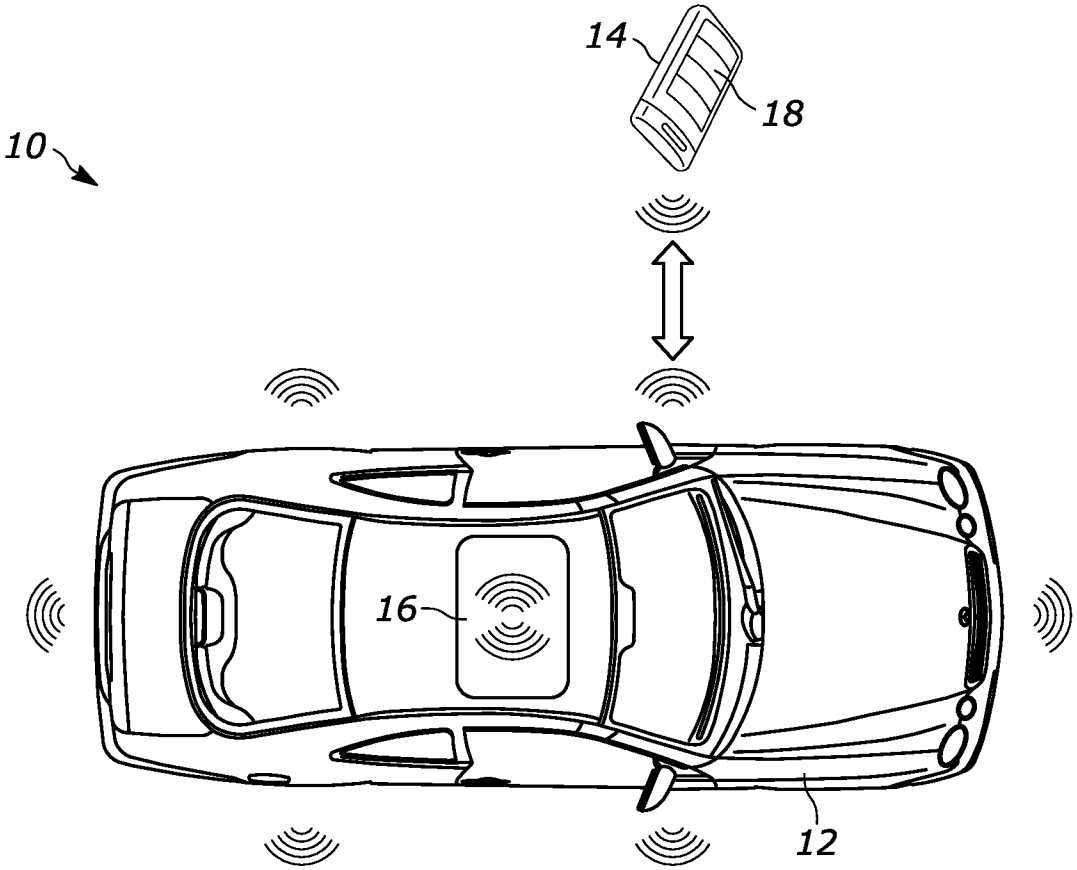
FIG. 1 is a schematic illustrating communication between a key fob and a vehicle, as well as a mobile device and the vehicle, according to one embodiment.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The present disclosure generally relates to the use of a mobile device to cause a physical depression of a button on a key fob, thus giving the owner of the vehicle the ability to control the vehicle via his/her mobile device. Key fobs may wirelessly communicate with a vehicle. A user can depress a button on the key fob to command various functions, such as lock the vehicle doors, unlock the vehicle doors, start the engine, open a trunk, open a door, initiate an alarm, etc. In newer vehicles, these functions are also available on a mobile device. For example, the owner of the vehicle may have a mobile device keyed to the controls of the vehicle; the owner can command similar functions (e.g., lock doors, unlock doors, start engine) on the owner's mobile device.

The disclosure herein enables a retrofitting of mobile-device control of the vehicle to a vehicle that otherwise is not equipped with the ability to be controlled via a mobile device. In other words, a user may own a vehicle that comes equipped with a keyed key fob for remote control functions of the vehicle. However, that vehicle may not come equipped with the ability for remote control functions to be initiated via the user's mobile device (e.g., using a "phone as a key" to the vehicle). This disclosure provides various embodiments for converting that vehicle into one in which the vehicle can be controlled by a mobile device. The key fob can be stored within a key fob actuator housing which can be mounted or otherwise stored in the vehicle, and which has one or more moveable actuators. The key fob actuator housing has a wireless receiver or transceiver configured to communicate with the user's mobile device. In response to a command from the user's mobile device, the moveable actuators of the key fob actuator housing are actuated to physically depress a corresponding one of the buttons of the user's key fob contained within the key fob actuator housing.

FIG. 1 illustrates an example of a wireless vehicle communication system 10 in which a vehicle 12 can wirelessly communicate with a key fob 14. The vehicle 12 may be a passenger vehicle such as a car, van, truck, sports-utility vehicle (SUV), all-terrain vehicle (ATV), motorcycle, and the like. The vehicle 12 may include a communication module 16, such as a receiver or transceiver, which transmits and/or receives information from devices external of the vehicle 12, such as the key fob 14. Likewise, the key fob 14 may include a communication module, such as a transmitter or transceiver, which transmits information to the communication module 16 of the vehicle 12. The wireless communication between the communication module 16 and that of the key fob may be made via Bluetooth or radio frequency. Functional and depressible buttons 18 on the key fob may cause the key fob 14 to transmit an associated signal to the communication module 16 to carry out a particular function designated by the button when the button is operated by a user. For example, when an "unlock" button is operated or depressed by the user, the key fob 14 transmits a signal via its communication module to the communication module 16 of the vehicle to unlock doors of the vehicle 10. They key fob 14 may include other functional buttons for sending other associated signals to cause associated actions in the vehicle, such as lock the doors, start the engine, initiate an alarm, open or close a trunk or lift gate, open or close a window, etc.

The control module of the key fob communicates with the functional buttons 18 of the key fob 14, and also communicates wirelessly with the communication module 16 of the vehicle 12. When a given functional button 18 is depressed or otherwise activated by the user, the control module within the key fob 14 receives an associated input therefrom, and transmits a signal to the communication module 16 of the vehicle. When the communication module 16 receives the signal from the key fob 14, the control module may communicate with a control module within the vehicle to determine whether a response is needed. If such a response is needed, the control module within the vehicle may communicate with one or more actuators for performing the respective action (e.g., a door lock/unlock actuator).

While not illustrated in FIG. 1, the communication module 16 may also be configured to receive wireless signals from a mobile device to perform the various commanded actions.

Figure 2:
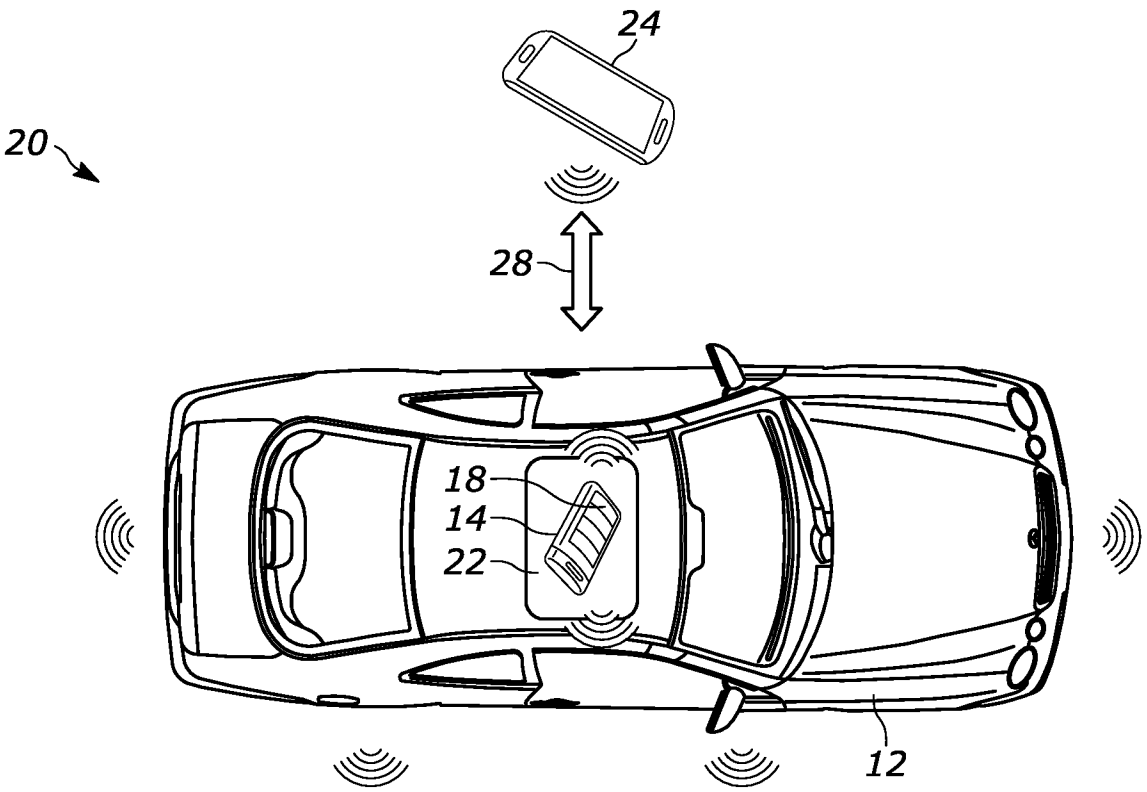
FIG. 2 is a schematic illustrating communication between a mobile device and a key fob actuator housing within the vehicle, according to one embodiment.

FIG. 2 illustrates an example of a wireless vehicle communication system 20 in which the key fob 14 may be placed within or associated with a key fob actuator housing 22 which is configured for wireless communication with a mobile device 24. The key fob actuator housing 22 with added wireless communication capabilities may be retrofit onto the vehicle 12 of FIG. 1 to create or enable the vehicle communication system of FIG. 2.

In embodiments, the key fob actuator housing 22 is a physical housing (e.g., box) that at least partially contains the key fob and that can be mounted, stored, or otherwise permanently connected to the vehicle. In application, the user can place his/her key fob 14 within the key fob actuator housing 22 for storage. The key fob actuator housing 22 can then receive commands from the mobile device 24 via wireless communication (e.g., Bluetooth, radio frequency, etc.). In response to the commands received from the mobile device 24, the key fob actuator housing 22 can actuate of one or more of the buttons 18 on the key fob to perform an associated action in the vehicle 12. The commanded actuation of the one or more buttons 18 can include a depression of one of the buttons, multiple depressions of one of the buttons, depression of multiple buttons at the same time, holding of one or more buttons for a threshold time, depending on the required button sequencing for a desired action in the vehicle to occur. For example, the user may utilize his/her mobile device 24 to request the vehicle 12 to be unlocked. The mobile device 24 then wirelessly communicates (e.g., via wireless communication link 28 in FIG. 3) a wireless signal to an associated receiver/transceiver within the key fob actuator housing 22, wherein the wireless signal contains a command to perform an action (e.g., start the engine). Based on the received signal from the mobile device 24, the key fob actuator housing 22 can then command an actuator within the key fob actuator housing 22 to actuate, causing two successive depressions of a respective one of the buttons 18 on the key fob 14 to perform the commanded action (e.g., start the engine).

Figure 3:
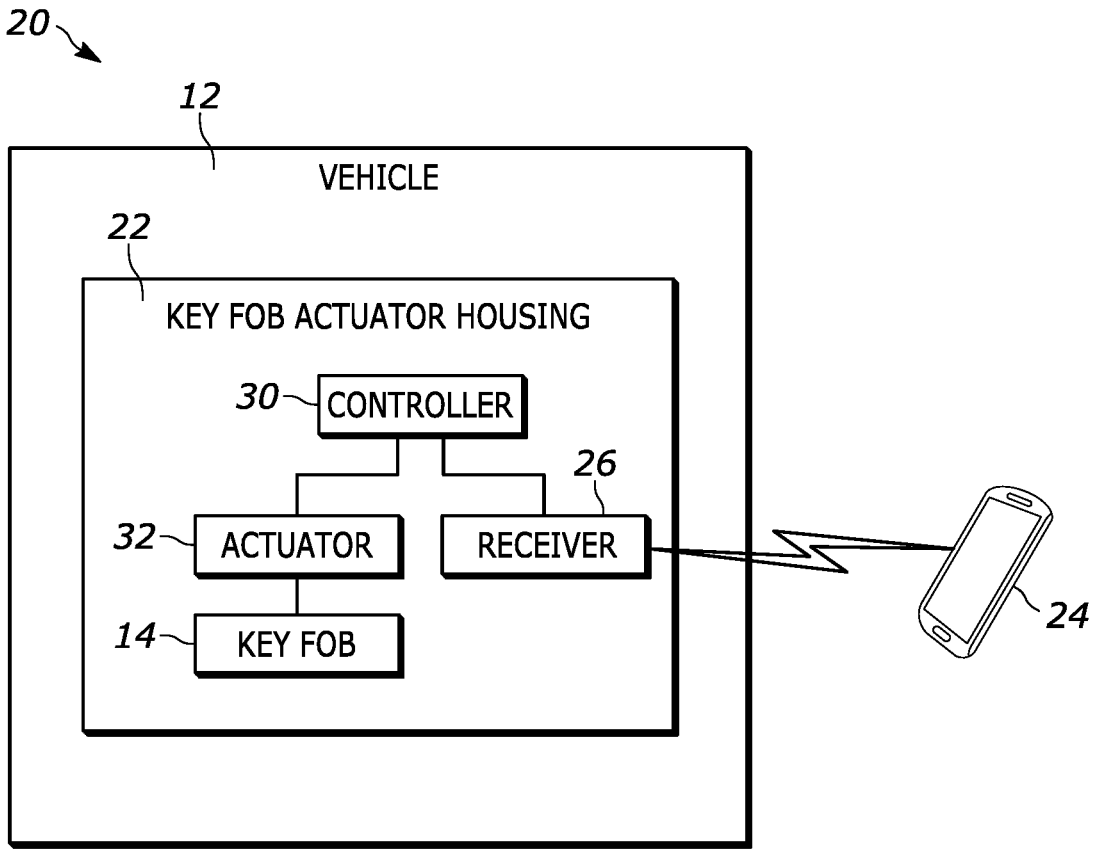
FIG. 3 is an example block diagram of the vehicle with the key fob actuator housing configured for wireless communication with the mobile device.

FIG. 3 illustrates a block diagram of the vehicle communication system 20, according to one embodiment. A user of the vehicle 12 has a mobile device 24. The mobile device 24 may be, for example, a cell phone, smart phone, tablet, personal digital assistant (PDA), or any other similar device having wireless remote network connectivity. In particular, the mobile device 24 may include wireless communication capabilities to wirelessly communicate with a wireless transceiver or receiver 26 in the key fob actuator housing 22 via the wireless communication link 28 that can be, for example, Bluetooth, near-field communication (NFC) radio-frequency identification (RFID), 4G/5G, ultra-wide band (UWB), or other similar forms of wireless communication. The receiver 26 may be mounted to or otherwise fastened to the key fob actuator housing 22.

The receiver 26 is controlled by and communicates with a controller 30. The controller 30 may initiate or "wake up" the receiver 26, whereupon the receiver 26 is ready and enabled to receive a signal from the transceiver of the mobile device 24. The receiver 26 may receive a signal from the mobile device 24 indicating a desired action (e.g., unlock doors, etc.). The receiver 26 then sends a signal to the controller 30 informing the controller 30 that such a signal was received. The controller 30 then deciphers which type action was commanded by the mobile device 24 by analyzing the particular signal received by the receiver 26. The controller 30 is then programmed to command an action by an actuator 32 (described in further detail below) based on the received signal.

The controller 30 can be any suitable controller for receiving information from a receiver or transceiver regarding a desired action as commanded by the user's mobile device 24, and correspondingly controlling the actuator 32 to physically depress a corresponding button of the key fob 14. In this disclosure, the terms "controller" and "system" may refer to, be part of, or include processor hardware (shared, dedicated, or group) that executes code and memory hardware (shared, dedicated, or group) that stores code executed by the processor hardware. The "controller" may also be included in the key fob actuator housing 22, or may be on another module such as a PCB board that is outside of the key fob actuator housing 22 but nonetheless communicates with the key fob actuator housing 22. The code is configured to provide the features of the controller and systems described herein. In one example, the controller 30 may include a processor, memory, and non-volatile storage. The controller 30 may also include the receiver and transceiver such as those described herein. The processor may include one or more devices selected from microprocessors, micro-controllers, digital signal processors, microcomputers, central processing units, field programmable gate arrays, programmable logic devices, state machines, logic circuits, analog circuits, digital circuits, or any other devices that manipulate signals (analog or digital) based on computer-executable instructions residing in memory. The memory may include a single memory device or a plurality of memory devices including, but not limited to, random access memory ("RAM"), volatile memory, non-volatile memory, static random-access memory ("SRAM"), dynamic random-access memory ("DRAM"), flash memory, cache memory, or any other device capable of storing information. The non-volatile storage may include one or more persistent data storage devices such as a hard drive, optical drive, tape drive, non-volatile solid-state device, or any other device capable of persistently storing information. The processor may be configured to read into memory and execute computer-executable instructions embodying one or more software programs residing in the non-volatile storage. Programs residing in the non-volatile storage may include or be part of an operating system or an application, and may be compiled or interpreted from computer programs created using a variety of programming languages and/or technologies, including, without limitation, and either alone or in combination, Java, C, C++, C#, Objective C, Fortran, Pascal, Java Script, Python, Perl, and PL/SQL. The computer-executable instructions of the programs may be configured, upon execution by the processor, to cause the controller 30 to command movement of the actuator 32 to perform a one of a certain number of available movements in order to cause the actuator 32 to cause a certain button 18 on the key fob 14 to be pressed, contacted, or otherwise actuated.

The controller 30 may be in communication with the receiver 26, the actuator 32, and other components of the key fob actuator housing 22 via a direct connection, such as via various input/output (I/O) ports of the controller 30. Additionally, the controller 30 may communicate with one or more of these components over one or more networks, such as a local controller area network (CAN), or a wireless local area network (WLAN), for example.

Figure 4:
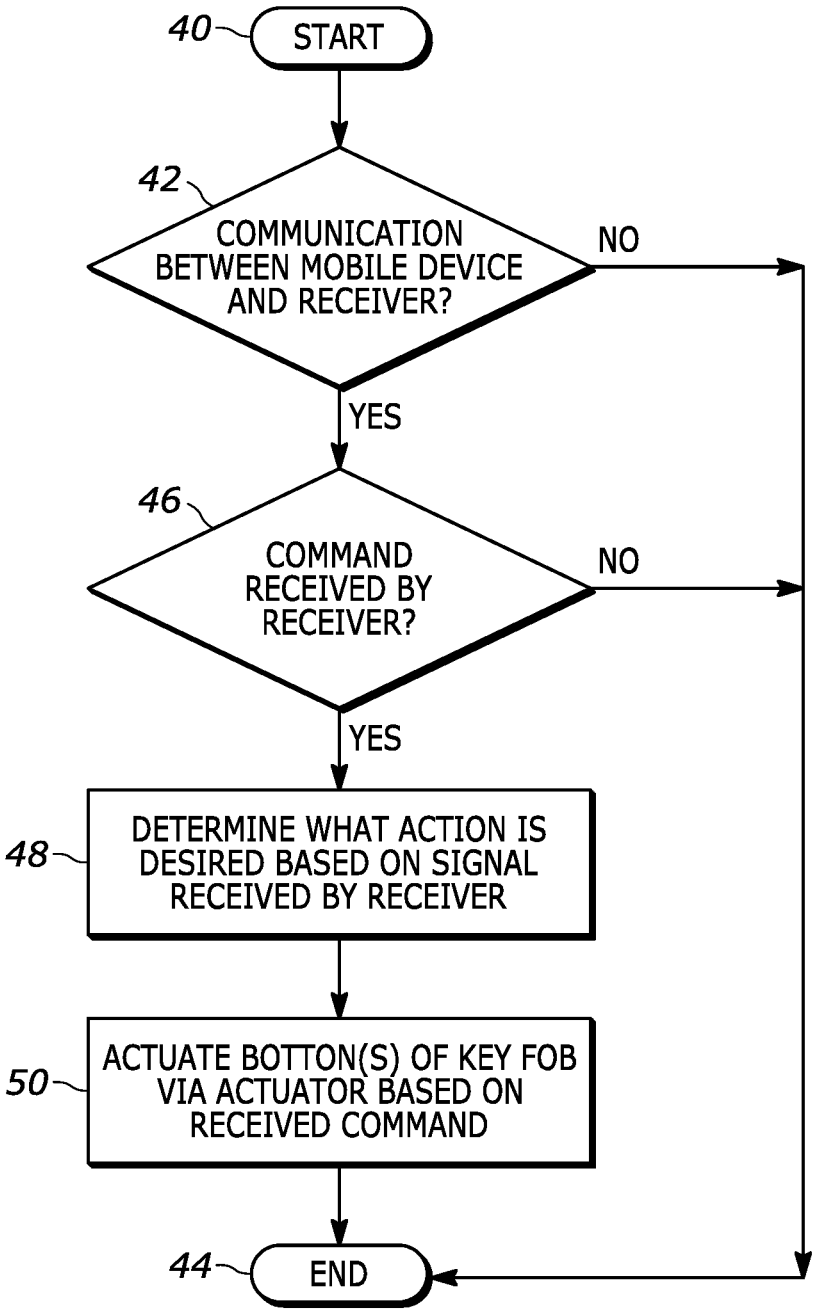
FIG. 4 is a flowchart of an example method for controlling various functions of the vehicle based on a wireless communication between the user's mobile device and the key fob within the key fob actuator housing.

FIG. 4. Illustrates a flowchart of an example method executed by the controller 30 for controlling the actuator 32 based on a wireless communication between the user's mobile device 24 and the key fob 14 within the key fob actuator housing 22. The method starts at 40. At 42, a determination is made as to whether communication is made between the mobile device 24 and the receiver 26. If no such communication is made, the method ends at 44. If such communication is made via the example communication links described above, then at 46 the controller 30 determines whether a command is received by the receiver 26 indicating a desired operation of the key fob 14. If no such command is received, then at the method ends at 44 and may return. If such a command is received, then at 48 the controller 30 determines what action is desired based on the particular signal received by the receiver 26. For example, the controller 30 may determine that the particular signal received by the receiver 26 is such a signal that is interpreted by the controller 30 to indicate a desire to start the vehicle. Then, at 50, the controller 30 sends a signal to the actuator 32 to actuate in a manner that causes a depression of the key fob 14 that matches with the respective type of signal received. For example, based on the determination that the user has desired to start the vehicle 12 based on the type of signal received from the mobile device 24, the controller 30 can cause the actuator 32 to move in such a way that the one of the buttons 18 on the key fob 14 is depressed to cause the vehicle's engine to start.

Figure 5A:
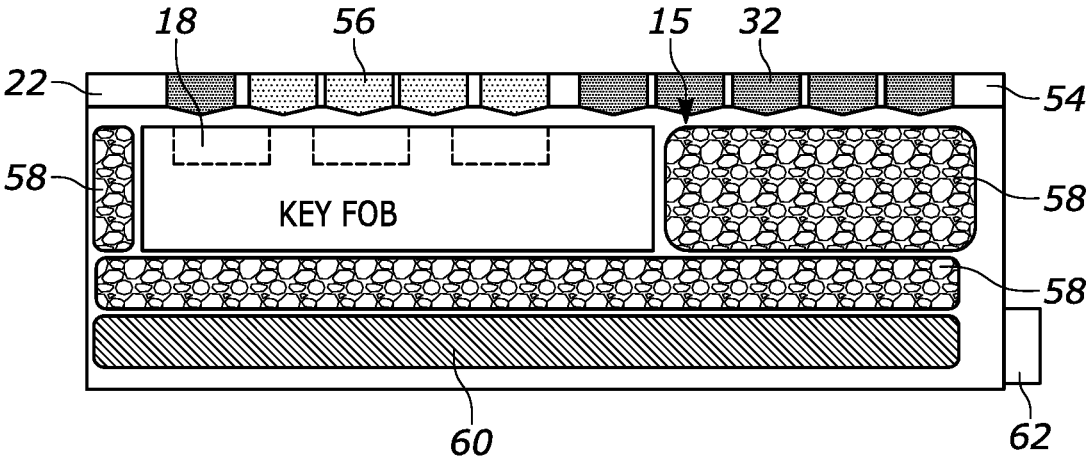
FIG. 5A is a side view of a schematic of the key fob actuator housing, according to one embodiment.
Figure 5B:
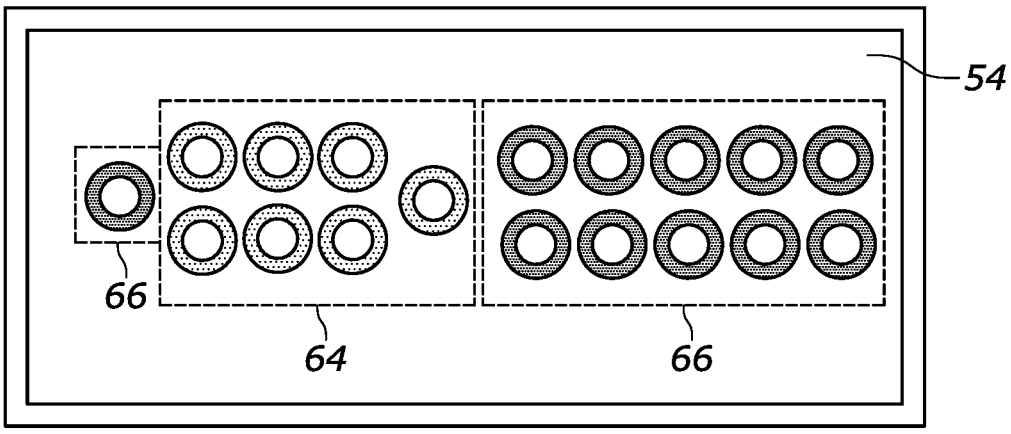
FIG. 5B is a bottom view of the interior of the top of the key fob actuator housing of FIG. 5A, illustrating various buttons for actuation in response to a command from the mobile device, according to one embodiment.
Figure 5C:
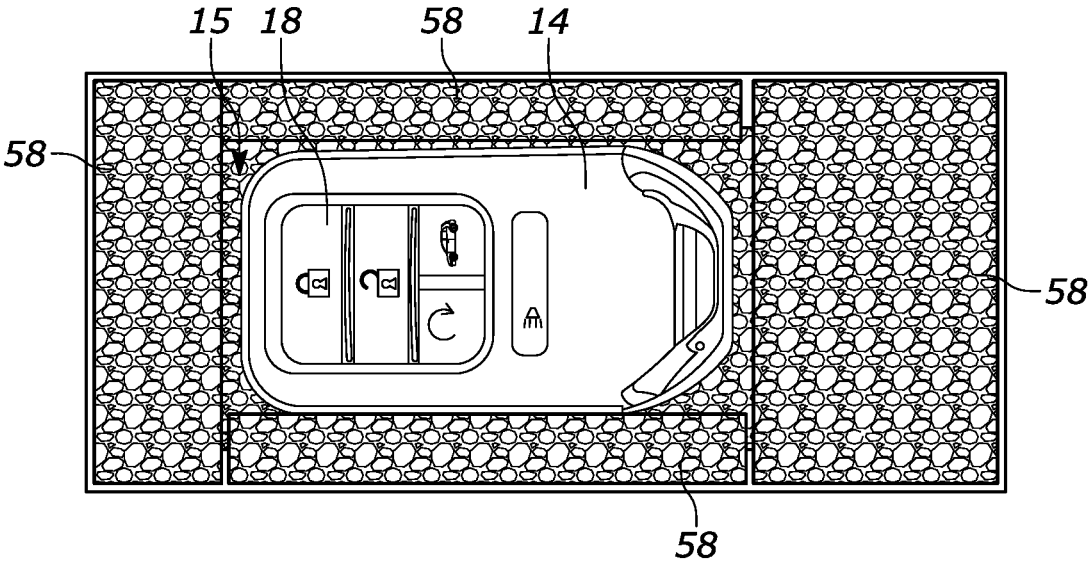
FIG. 5C is a top view of the interior of the key fob actuator housing of FIG. 5A, illustrating the key fob housed therein, according to one embodiment.

FIGS. 5A-5C illustrate an embodiment of the key fob actuator housing 22 for attachment within the vehicle 12. FIG. 5A shows a schematic cross-sectional view of the key fob actuator housing 22 with the key fob 14 located therein. FIG. 5B shows an underside of an upper portion or lid 54 of the key fob actuator housing 22, showing a layout of a plurality of actuators 32 thereon. FIG. 5C shows an overhead view of the interior of the key fob actuator housing 22 with the lid 54 removed, showing the key fob 14 in secured position.

Referring to FIG. 5A, the key fob 14 is located within an interior 15 or pocket within the key fob actuator housing 22. The key fob actuator housing 22 may include a plurality of the actuators 32. Each actuator 32 may be a solenoid 56, or other such electromechanical driver. Each solenoid 56 may contain a coil of wire that generates a magnetic field, thereby moving a core that is made of a magnetic material (e.g., metal such as iron or steel). Applying a current to the coil causes the core to be pushed or pulled relative to the coil. In the illustrated embodiment, the solenoids 56 are arranged such that energizing of the coils of the solenoids causes linear movement of the cores downward toward the key fob 14. A release or deenergizing of the coils allows the cores to move linearly away form the key fob 14. This type of electromechanical driver is but one of a plurality of types of actuators; other embodiments of actuators are described with reference to FIGS. 6-7 below.

The key fob actuator housing 22 may be provided with an insulating material to securely house the key fob 14. For example, a rubber or foam 58 may be provided, surrounding the bottom and sides of the key fob 14. This helps secure the key fob 14 in proper position during travel. In other embodiments, a strap or fastener may be used in addition or instead of the insulating material to further secure the key fob 14.

Beneath the insulating material is electronics 60. The electronics 60 may be or include a printed circuit board (PCB) including the controller 30, the receiver 26, electronic wires making an electronic connection, and other such structure allowing the electronic control of the actuators 32 as described herein.

Figure 9:
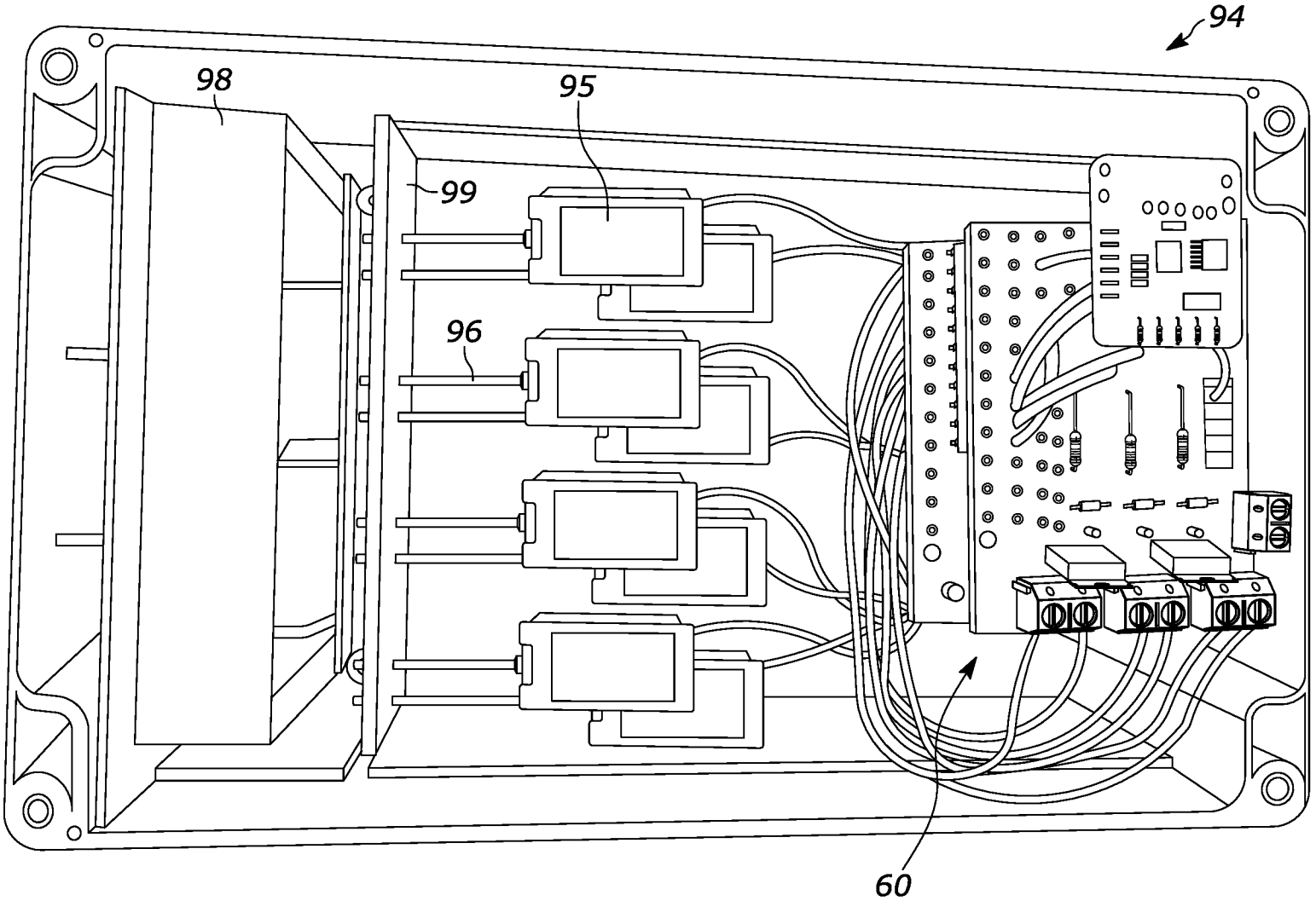
FIG. 9 is an overhead view of an interior of a key fob actuator housing according to another embodiment.

A power connection 62 is also provided for the key fob actuator housing 22. The power connection allows an outside power source (e.g., battery, 12-volt port, cigarette lighter port, auxiliary power outlet, universal serial bus (USB), etc.) to provide power to the electronics 60 and the electrical components included therein. Additional details regarding the power supply and the power connection 62 are provided with reference to FIGS. 9-10 described below. In short, various embodiments are contemplated for powering the components of the key fob actuator housing 22. In one embodiment, there can be batteries in the key fob actuator housing 22 itself. This allows the housing itself to be placed anywhere in the vehicle. In another embodiment, the housing 22 is connected to a power port (not shown) on the vehicle 12. This embodiment would eliminate the need for additional batteries, but may require the housing 22 to be located close to a power port, thereby potentially limiting the location that the housing 22 can be placed.

In application, the power connection 62 powers the electronics 60, including the controller 30 and the receiver 26, along with the actuators 32. The receiver 26 within the electronics 60 receives a wireless signal from the user's mobile device 24. Based on that signal, the controller 30 sends a corresponding signal to direct electric power to one or more of the solenoids 56 via the electronics 60. This causes the one or more solenoids 56 to actuate, moving linearly (e.g., downward, sideways, upward, etc. depending on the layout of the key fob actuator housing 22) to press one of the buttons of the key fob 14 beneath the lid 54 of the key fob actuator housing 22.

The key fob actuator housing 22 may be provided with a set of the actuators 32 (e.g., solenoids 56) in a disbursed layout, such as that illustrated in FIG. 5B. The set of actuators 32 may include a first subset 64 of actuators, and a second subset 66 of actuators. The first subset 64 of actuators may be located above or aligned with a button 18 of the key fob 14, and the second subset 66 of actuators may not be located above or aligned with a button 18 of the key fob 14. In other words, the first subset 64 of actuators may be "active" such that, when commanded by the controller 30, they actuate a button 18 of the key fob 14. The second subset 66 of actuators may be "inactive" or "disabled" such that, even if actuated, they do not actuate a button 18 of the key fob.

The controller 30 may control which actuators 32 are active (e.g., within the first subset 64) and which actuators 32 are inactive (e.g., within the second subset 66). This determination may be made by the user. For example, the particular key fob 14 used in the key fob actuator housing 22 may be for a specific make and model of vehicle (e.g., 2020 Toyota Corolla). The user may input this information into the mobile device 24 upon setup of the key fob actuator housing 22. The mobile device 24 and/or the controller 30 may be provided with a database of key fob layouts of various vehicles. In response to the user providing his/her make and model of vehicle, the mobile device 24 and/or controller 30 may designate each individual actuator 32 as being either active or inactive. Active actuators (e.g., the first subset 64 of actuators) may be located above a respective button 18 of the key fob 14, while inactive actuators (e.g., the second subset 66 of actuators) may be located above a region of the key fob 14 that has no button, or not located above the key fob 14 at all. Therefore, in certain embodiments, the number of actuators (e.g., solenoids 56) may exceed the number of buttons 18 of the key fob 14 such that the number of actuators can accommodate a variety of key fob layouts of various key fobs.

However, the key fob actuation housing 22 is configured to contain various key fobs with various key fob layouts. If the key fob 14 is removed and/or replaced with a second key fob having a different layout, the user can input the make and model of that vehicle into the controller 30 or mobile device 24, at which point the controller 30 or mobile device 24 can utilize a lookup table to determine which actuators are now designated as active and which are designated as inactive. In other words, while the first subset 64 of actuators may have been suitable for actuation of one or more buttons 18 of the key fob 14, the second subset 66 of actuators may be suitable for actuation of one or more buttons of a second key fob.

In an embodiment, each specific command from the mobile device 24 (e.g., unlock doors, lock doors, start engine, etc.) can be keyed to one or more specific actuators for that specific make and model of vehicle. For example, the mobile device 24 may be provide with information regarding the make and model of the vehicle 12. In response to a user input indicating one of the specific commands via the mobile device 24 (e.g., lock doors), the controller 30 can look up which one or more actuators 32 is properly located above the "lock" button of the key fob for that particular vehicle, and actuate that actuator 32 to depress the particular "lock" button. If another key fob having a different layout is utilized, the controller 30 may determine that another one of the actuators 32 is properly located above the "lock" button of that key fob and actuate that actuator. The correlation between the actual make and model of vehicle, the layout of the key fob, and the use of particular actuators 32 to accomplish the desired command can be provided via a lookup table stored in the controller 30, in the mobile device 24, or in the cloud or wireless network that the mobile device 24 communicates with.

Figure 6:
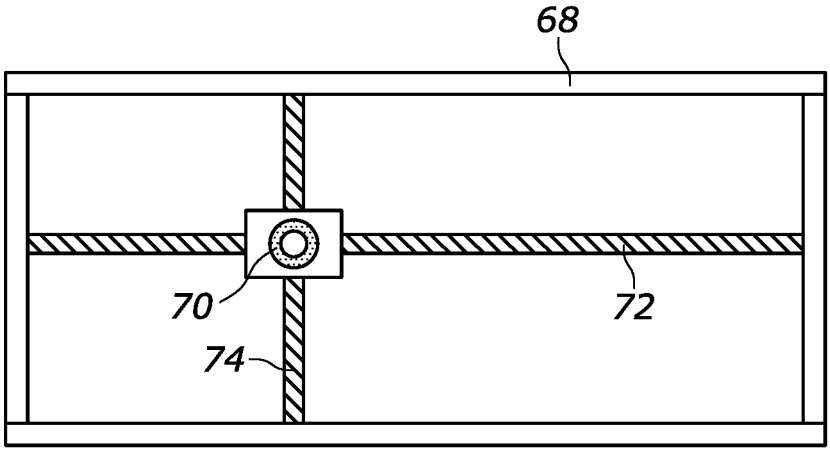
FIG. 6 is a bottom view of the interior of a top of the key fob actuator housing according to another embodiment in which an actuator can move along a two-dimensional plane.

FIG. 6 is a view of the underside of the lid of the key fob actuator housing, similar to the view shown in FIG. 5B, according to another embodiment. In this embodiment, the lid 68 is provided with a single actuator (e.g., solenoid 70). The solenoid 70 is moveable along a two-dimensional plane. For example, a first rod 72 and a second rod 74 may be provided for movement of the solenoid. The first rod 72 may extend in a horizontal direction (X-axis) in the orientation shown in FIG. 6, and the second rod 74 may extend in a vertical direction (Y-axis) in the orientation shown in FIG. 6. The solenoid 70 may attach to both rods 72, 74 at an intersection thereof, while able to transverse along each rod 72, 74. In one embodiment, the solenoid 70 is provided with its own pinion, and each rod 72, 74 is a rack that enables a rack-and-pinion interaction and movement of the solenoid 70 along the rods 72, 74. The movement of the solenoid may be controlled by the controller 30 according to a desired location of actuation, pursuant to the disclosure above regarding determining a proper location for actuation depending on the layout of the particular key fob.

Figure 7A:
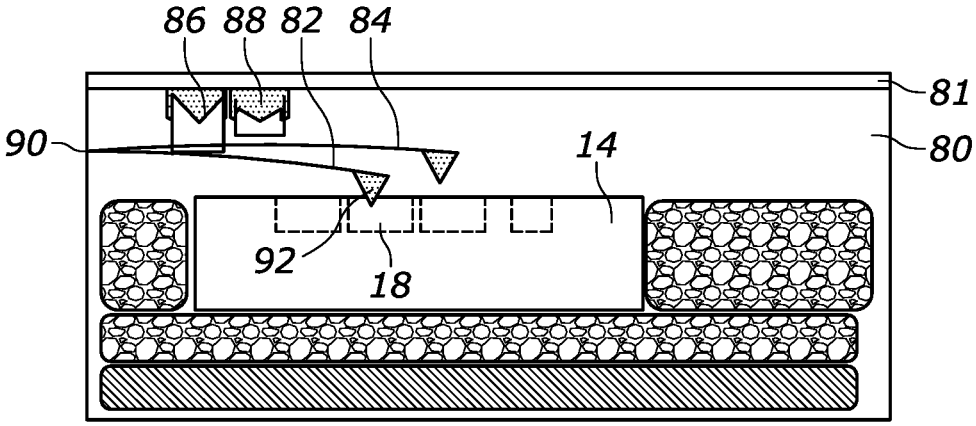
FIG. 7A is a side view of a schematic of a key fob actuator housing according to another embodiment in which levers are utilized for actuating buttons on the key fob.
Figure 7B:
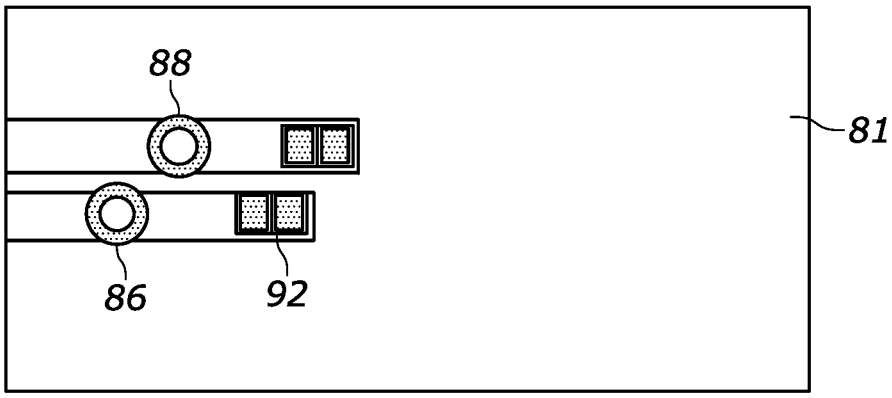
FIG. 7B is a bottom view of the interior of the top of the key fob actuator housing of FIG. 7A, according to one embodiment.

FIG. 7A illustrates a cross-sectional schematic view of the interior of a key fob actuator housing 80 according to another embodiment. FIG. 7B is a view of the underside of a lid 81 of the key fob actuator housing 80. In this embodiment, a plurality of flexible levers are provided, such as a first lever 82 and a second lever 84. A first solenoid 86 is connected to or associated with the first lever 82, and a second solenoid 88 is connected to or associated with the second lever 84. In this embodiment, a proximal end 90 of each lever provides a fixed point for pivoting relative thereto. A distal end 92 provides a point of contact to one of the buttons 18 of the key fob 14.

As shown in FIG. 7A, the first solenoid 86 is actuated (e.g., by the controller 30). This causes a bend of the first lever 82, forcing the proximal end 90 of the first lever 82 to contact the button 18 of the key fob 14 associated with the first lever 82. Once again, the controller 30 and/or the mobile device 24 can coordinate a desired action to be performed by the key fob actuator housing (e.g., unlock doors) with a particular solenoid (e.g., solenoid 86 or 88) depending on the layout of the particular key fob 14.

Figure 8:
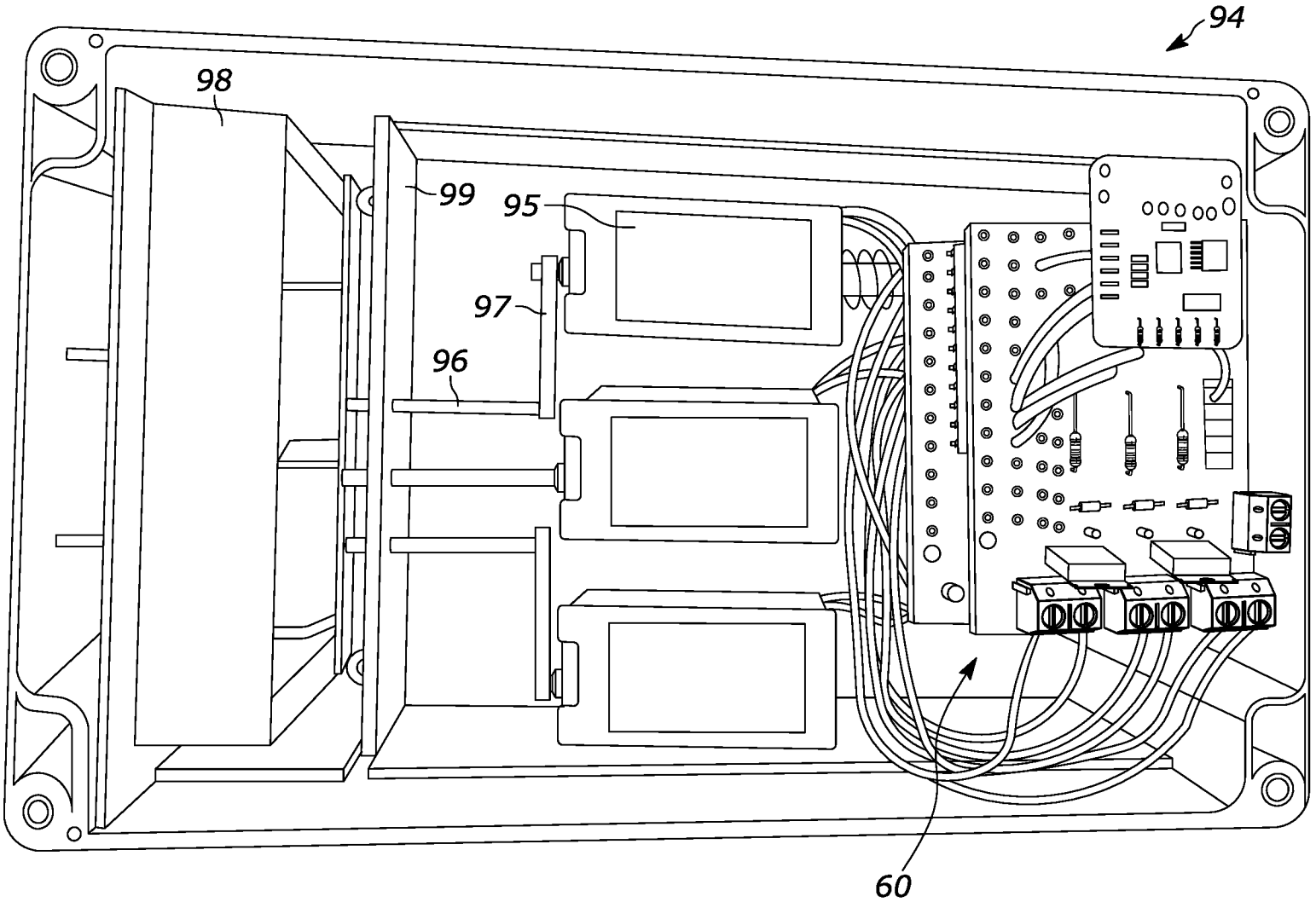
FIG. 8 is an overhead view of an interior of a key fob actuator housing according to another embodiment.

FIG. 8 illustrates an interior view of a key fob actuator housing 94 according to another embodiment. In this embodiment, all electronics 60, actuators (e.g., solenoids), etc. are located within the interior of the key fob actuator housing 94, and nothing is in the lid (removed from this illustration). Each actuator, represented in this Figure by solenoids 95, is coupled to a respective rod 96. The key fob 14 can be placed in a separate container 98 that is removable and can be filled with rubber, foam or other material that can aid securement and prevent unwanted movement of the key fob 14 during vehicle travel. Each rod 96 also extends through an alignment plate 99 that properly maintains alignment of the rods 96 so that accurate locational depression of the key fob 14 is assured. The alignment plate 99 may have a plurality of apertures configured to receive the rods 96 at a desired location.

A mechanical link 97 may connect the solenoid 95 to the rod 96. The mechanical link 97 may be fastened or otherwise secured to both the solenoid 95 and the rod 96. This allows proper customization of the precise location of actuation placed on the key fob 14 from the solenoid 95. In other words, rather than having the rod 96 colinear with the output of the solenoid (as is the case with the solenoid 95 in the middle of the group of three solenoids in FIG. 8), the link 97 can shift the location of the rod 96, and thereby shift the location of the depression of the key fob 14. The shape, size, and implementation of the link 97 can vary depending on the type of key fob 14 utilized in the key fob actuator housing 94, thereby allowing the solenoids to work for various types of key fobs.

While only three solenoids 95 are illustrated in FIG. 8, it should be understood that more than three solenoids can be utilized. For example, the size of the solenoids 95 can be reduced to allow for more solenoids to fit within the key fob actuator housing 94. This is shown, for example, in FIG. 9. In this embodiment, there are eight solenoids 95, each having a respective rod 96 extending through the alignment plate 99. No link 97 may be necessary in this embodiment, as each solenoid 95 directly controls linear movement of a respective rod 96, which presses linearly toward the key fob located within the container 98.

The relatively large number of solenoids (e.g., eight) relative to the typical number of buttons on a key fob (e.g., three to five) allows for a first subset of the solenoids to be used for a first type of key fob, and a second subset of the solenoids to be used for a second type of key fob. This is another way of enabling the key fob actuator housing to be universal for different makes and models of key fobs. For example, if an Audi key fob is used within the key fob actuator housing, only some (e.g., four) of the solenoids would be required to press the various buttons. If a user wanted to then use a Ford key fob, the Audi key fob would be removed and replaced with the Ford key fob, the user can select a configuration on his mobile device that informs the controller associated with the key fob actuator housing to select a different group of solenoids for actuation of the buttons on the Ford key fob. If there was a key fob that was not pre-programmed in the application on the mobile device, the rods within of the key fob actuator housing can be adjusted accordingly.

Figure 10:
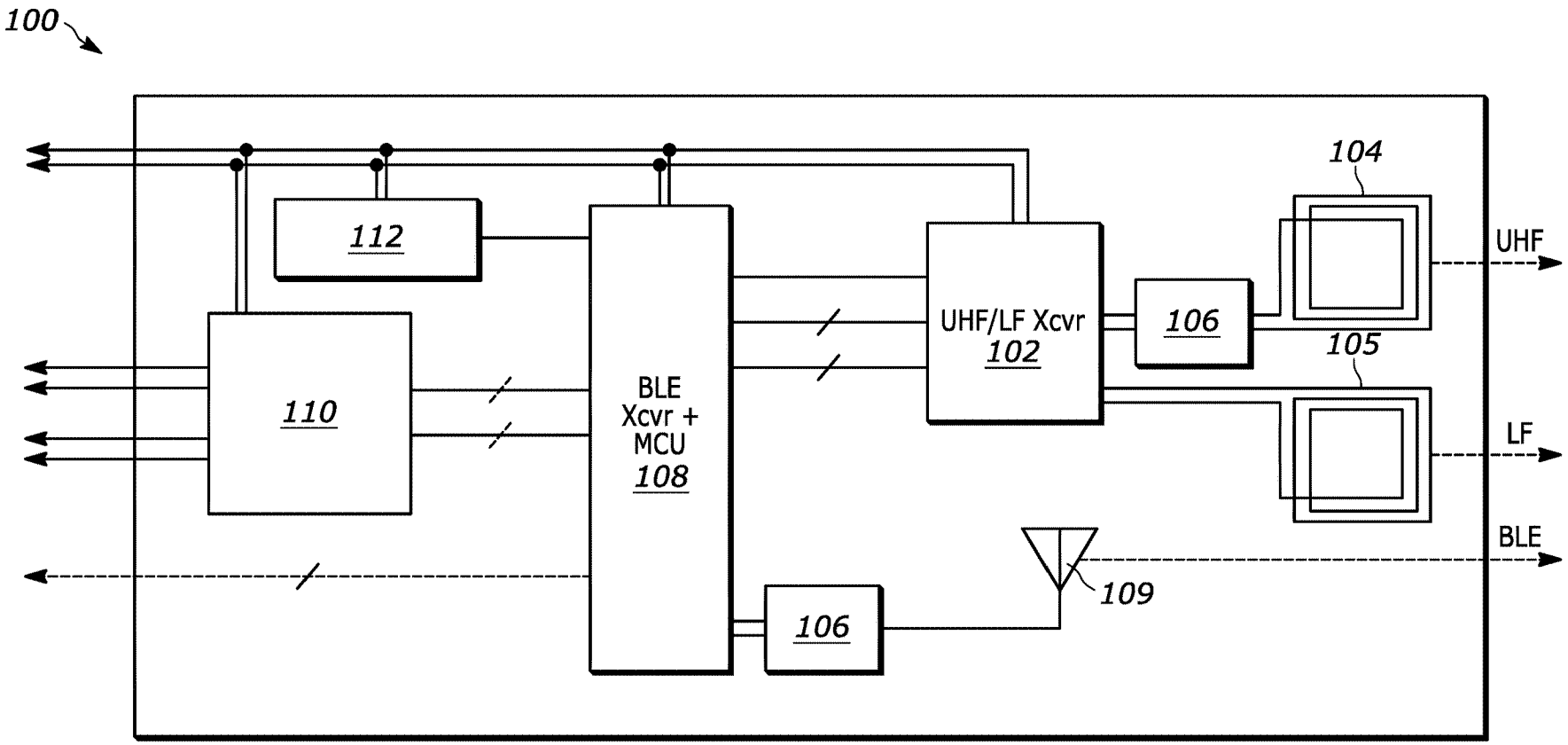
FIG. 10 is an exemplary block topology of the key fob actuator housing implementing wireless communication with the user's mobile device.

FIG. 10 is an example of a block topology of a communication system 100 for the key fob actuator housing 22 to implement wireless communication with the user's mobile device 24. Various transceivers, receivers, and controllers are shown herein, all of which can be part of the electronics 60 described above, and can collectively be referred to as a "controller" as explained above and used herein. In other words, the block topology represented in FIG. 10 represents one example of an overall "controller" used to communicate with the mobile device 24 and send signals to the actuators 32 within the key fob actuator housing 22.

The communication system 100 may include an ultra-high frequency (UHF) and/or a low frequency (LF) transceiver 102 with an associated antenna 104, 105 for each of the UHF and LF wavelengths, configured to send/receive wireless signals, for example, at a frequency of 433 MHz and/or 315 MHz. A filter 106 may also be provided to filter the wireless signal prior to the signal being sent to a micro-control unit (MCU) 108. The MCU 108 may be programmed to send commands to the actuators 32 based on the wireless signals received, as explained above.

The MCU 108 may also have an on-board Bluetooth low-energy (BLE) transceiver configured to send and/or receive signals via BLE. The BLE transceiver may be a separate component separate from the MCU 108. The BLE transceiver may communicate via an antenna 109 configured to send and receive BLE signals, for example at 2440 MHz. The MCU 108 may also control operation of the UHF/LF transceiver 102.

The communication system 100 may also include a control area network (CAN) system basis chip (SBC) 110. The CAN SBC 110 provides an interface between the CAN bus and the MCU 108, BLE transceiver, and UHF/LF transceiver through serial peripheral interface (SPI), for example, enabling communication between these components. The communication system 100 may also include a high-input voltage supervisors (reset IC) 112 that can operate at up to 10 volts while maintaining very low quiescent current across all operating conditions. This provides a combination of minimal power consumption, high accuracy, and low propagation delay to help extend battery life of the electronics 60.

Figure 11:
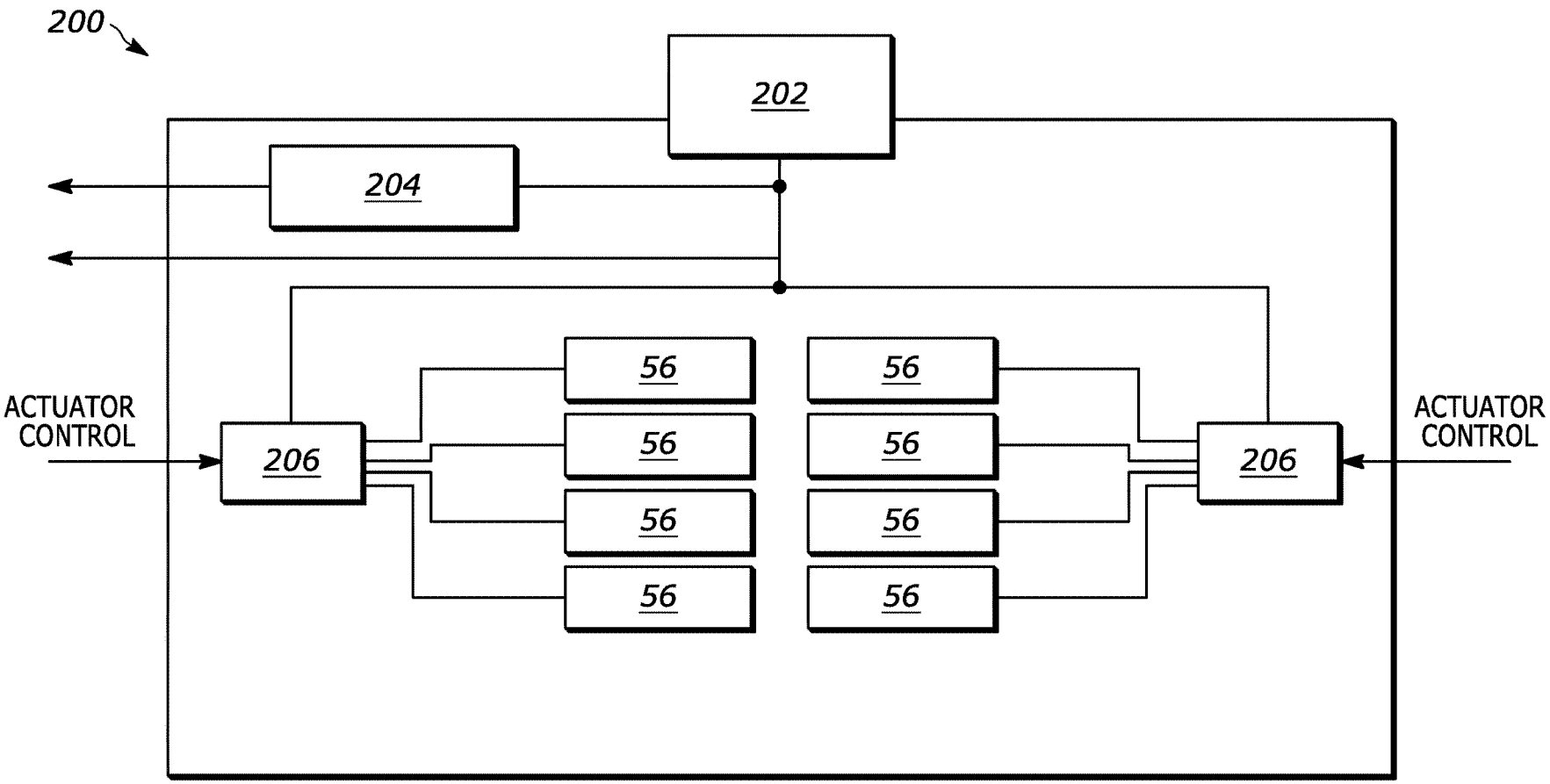
FIG. 11 is an exemplary block topology of an electrical powering of the key fob actuator housing, according to one embodiment.

FIG. 11 is an example of a block topology of an electrical power system 200 for powering the key fob actuator housing 22, according to one embodiment. This embodiment may be useful in a situation in which it is desired to connect the key fob actuator housing 22 to a power source without using any batteries, for example. The electrical power system 200 can receive electrical power from an external power source 202, such as via an assembly line diagnostic link (ALDL), a cigarette lighter port, or a 12-volt plug line, for example. The external power source 202 may also be via another port in the vehicle, such as a USB port. The electrical power incoming into the actuator housing 22 can feed the electronics 60, including the controller 30 and actuators (e.g., solenoids 56).

The electrical power may pass through a linear regulator 204 that may employ an active pass device controlled by a high gain differential amplifier. The linear regulator may be configured to compare the output voltage with a precise reference voltage and adjusts the pass device to maintain a constant output voltage (e.g., 3.3 volts).

The electrical power system 200 may also include high-side drivers 206. These high-side drivers may include switches that are controlled by the controller 30 or MCU 108, for example. Each high-side driver 206 may be connected to one or more of the solenoids 56. In one example of operation, when it is desired to press a button 18 on the key fob 14, the controller 30 may send a signal to the high-side drivers 206, which will then activate the solenoids 56, causing one or more of the solenoids 56 to press a respective one or more of the buttons 18 on the key fob. In another embodiment, the high-side drivers 206 can be replaced by transistors or other such structure that can drive the solenoids 56 by generating enough current to do so.

Figure 12:
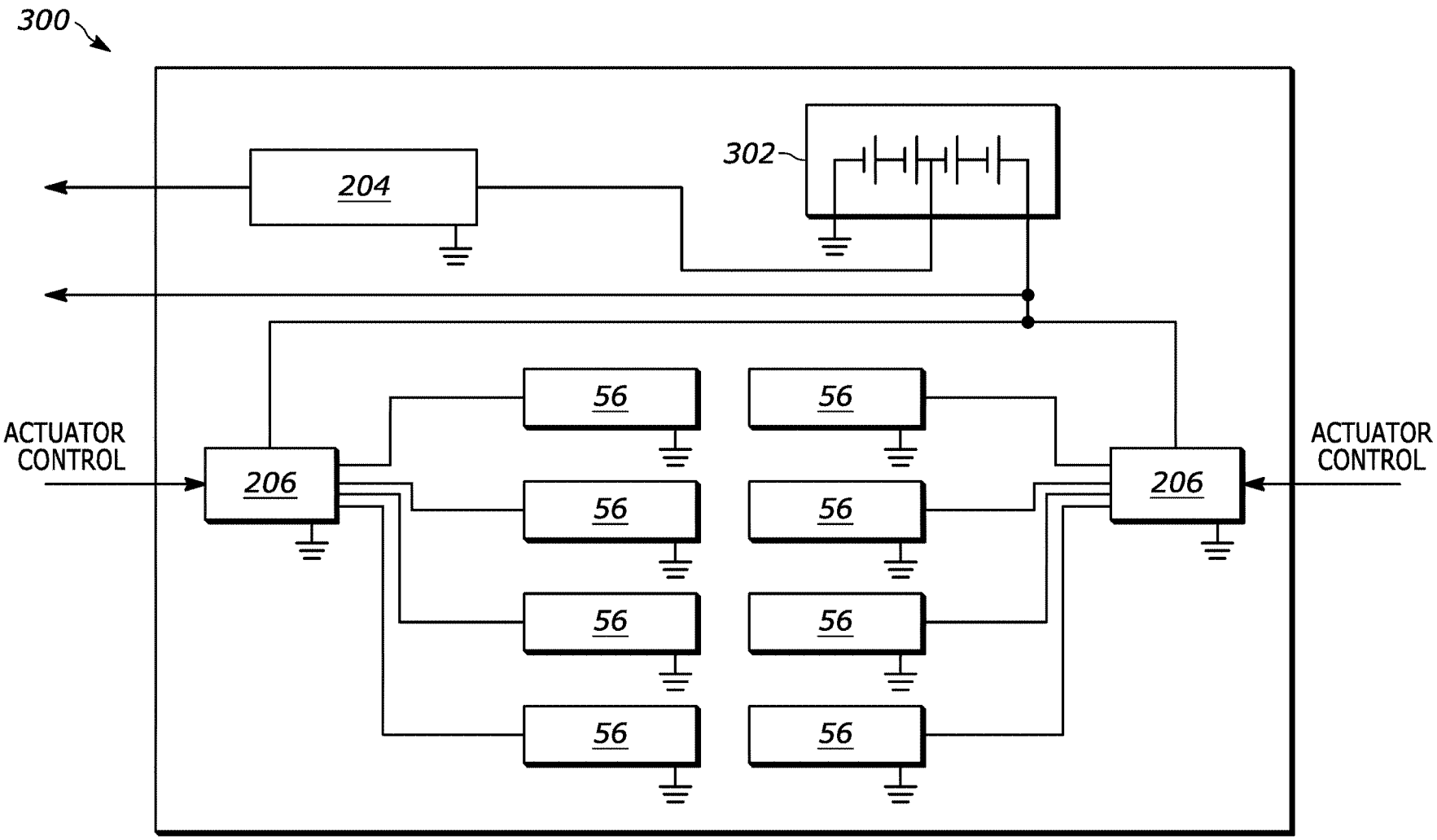
FIG. 12 is an exemplary block topology of an electrical powering of the key fob actuator housing, according to another embodiment.

FIG. 12 is an example of a block topology of an electrical power system 300 for powering the key fob actuator housing 22, according to another embodiment. In this embodiment, one or more batteries 302 provide the electrical power source for the electrical power system 300. The batteries 302 may include, for example, a plurality (e.g., eight) AA batteries. This allows the user to easily remove and replace the batteries to keep this electrical power system 300 operating without having to physically couple the key fob actuator housing 22 to a power source that is on-board the vehicle 12. This also provides greater flexibility, providing the user with an ability to place the key fob actuator housing 22 in various locations about the vehicle, rather than being confined near an electrical port to couple to hard wires of the vehicle 12. The electrical power system 300 also includes a linear regulator 204 and high-side drivers 206 that operate similarly to those of FIG. 11.

Embodiments of the key fob actuation housings described herein can be used in the rental vehicle business, or ride share business. For example, a rental car company may have a fleet of vehicles that are not equipped by the OEM with the ability to be controlled via a mobile device 24. The rental car company can convert the vehicles such that they can be controlled via a mobile device 24 by equipping the vehicle with the key fob actuation housing. When the user selects a particular vehicle 12 for rent, the rental company can provide the user with a virtual key on his/her mobile device, syncing the user's mobile device 24 with the key fob actuation housing 22 of the rented vehicle. No transfer of physical keys is necessary, thereby reducing the likelihood of loss, theft, or damage of the vehicle and/or the key fob 14 associated with the vehicle 12. When the user is finished with his/her period of rental of the vehicle 12, the rental car company can deactivate the virtual key on the mobile device so that the user is no longer able to control the vehicle 12 via his/her mobile device 24.

Embodiments of the key fob actuation housings described herein can also be used as part of a passive entry/passive start (PEPS) vehicle. For example, the mobile device 24 can communicate with the electronics (e.g., controller 30, receiver 26) via Bluetooth or NFC. As the mobile device 24 is detected by the receiver as being within a certain threshold distance from the vehicle, or approaching at a certain angle of approach, the controller 30 can send a signal to actuate one or more of the actuators 32 to depress the unlock button on the key fob 14. Once the vehicle is unlocked, it may be detected that the user's mobile device is located within the vehicle, and a depression of a stop/start button within the vehicle enables the vehicle to be started. This is due to the key fob 14 being mounted in the key fob actuator housing 22 at a location within the vehicle 12, thus allowing a start of the engine. Likewise, as the mobile device 24 is detected to transition to a certain distance from the vehicle outside of a threshold, the controller 30 can send a signal to actuate another of the actuators 32 to depress the lock button on the key fob 14.

The key fob actuator housing 22 and accompanying systems may be provided with the ability to block certain key fob signals for safety and security. In one embodiment, the key fob 14 communicates with a body control module of the vehicle 12 that performs certain functions such as unlocking the doors of the vehicle 12. If the user's mobile device 24 is not in range of the key fob actuator housing 22, or if communication between the mobile device 24 and the receiver 26 of the key fob actuator housing 22 is not established, then any signals emitting from the key fob 14 can be blocked or disabled to avoid theft. This can be done in various manners. For example, the transmitted signal from the key fob 14 can be interrupted with a signal from a transmitter on the key fob actuator housing 22 with same frequency, thereby cancelling out the signal from the key fob 14. In another embodiment, a metal shield can be placed over the key fob 14 when not in use, thereby preventing the transmitted signal from the key fob 14 from reaching the body control module. This can be done with a retractable or extendable metal shield that can be automatically controlled (e.g., via the controller) to cover the key fob 14 when the mobile device is not in range. In another embodiment, the battery that powers the key fob 14 can be disabled or otherwise prevented from powering the key fob 14 unless or until the mobile device 24 is in range of the key fob actuator housing 22 and establishes a connection thereto.

While embodiments above disclose the key fob actuator housing 22 as physically including certain components such as the receiver(s) 26 and controller(s) 30, these components and others shown can be located physically outside of the key fob actuator housing 22, but nonetheless configured to translate a desire to control the key fob 14 by actuating buttons on the key fob.

While not shown in the illustrations herein, it should be understood that additional intermediate structure may be provided between the actuator (e.g., solenoid) and the buttons 18 of the key fob 14. For example, a servo or cam may be coupled to or part of the actuator such that movement of the actuator (e.g., solenoid) causes corresponding movement of the intermediate structure, which ultimately causes the buttons 18 to be activated. This additional structure may be provided depending on the desired layout of the key fob actuator housing 22.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A system for enabling control of a vehicle key fob via a mobile device, the system comprising:

a key fob actuator housing having a set of actuators configured to selectively actuate one or more first buttons of a first key fob that has a first button configuration and one or more second buttons of a second key fob that has a second button configuration different than the first button configuration, the set of actuators having a first subset of actuators configured to selectively actuate the one or more first buttons of the first key fob, and a second subset of actuators configured to selectively actuate the one or more second buttons of the second key fob;

a receiver configured to receive a signal from a mobile device containing information related to a desired function of the vehicle; and a controller coupled to the receiver and programmed to command one of the actuators within the first subset of actuators to actuate one of the one or more first buttons based on the information related to the desired function.

2. The system of claim 1, wherein the controller is further programmed to command one of the actuators within the second subset of actuators to actuate one of the one or more second buttons of the second key fob based on the information related to the desired function.

3. The system of claim 1, wherein at least one of the actuators in the first subset of actuators is also in the second subset of actuators.

4. The system of claim 1, wherein none of the actuators in the first subset of actuators are in the second subset of actuators.

5. The system of claim 1, wherein the key fob actuator housing further comprises electronics including the receiver and the controller.

6. The system of claim 1, wherein the actuators are solenoids configured to, when energized, move linearly toward the first or second key fob.

7. The system of claim 6, wherein the solenoids are disposed on a lid configured to cover the first or second key fob.

8. The system of claim 1, wherein the controller is programmed to receive information identifying the vehicle, and assign the actuators as being within either the first subset or the second subset based on the information identifying the vehicle.

9. The system of claim 1, wherein each actuator of the first subset of actuators and the second subset of actuators is fixed to move along a single respective axis only.

10. A key fob actuator housing for a vehicle, the key fob actuator housing comprising:

an interior configured to receive one of a first key fob having a first plurality of buttons in a first button layout, and a second key fob having a second plurality of buttons in a second button layout;

a first plurality of actuators associated with the first plurality of buttons, and a second plurality of actuators associated with the second plurality of buttons;

a receiver configured to receive a signal from a mobile device containing information related to a desired function of the vehicle; and a controller coupled to the receiver and programmed to:

command one of the first plurality of actuators to actuate one of the first plurality of buttons based on the information related to the desired function, and command one of the second plurality of actuators to actuate one of the second plurality of buttons based on the information related to the desired function.

11. The key fob actuator housing of claim 10, wherein at least one of the actuators of the first plurality of actuators is also in the second plurality of actuators.

12. The key fob actuator housing of claim 10, wherein none of the actuators in the first plurality of actuators are in the second plurality of actuators.

13. The key fob actuator housing of claim 10, further comprising a power connection configured to receive electric power from an external power source and transmit the electric power to the controller, receiver, and first and second plurality of actuators.

14. The key fob actuator housing of claim 10, further comprising a battery configured to power to the controller, receiver, and first and second plurality of actuators.

15. The key fob actuator housing of claim 10, wherein the actuators are solenoids configured to, when energized, move linearly toward the first or second key fob.

16. The key fob actuator housing of claim 15, further comprising a lid configured to cover the first or second key fob, wherein the solenoids are disposed on the lid.

17. The key fob actuator housing of claim 10, wherein the controller is programmed to receive information identifying the vehicle, and assign the actuators as being within either the first plurality of actuators or the second plurality of actuators based on the information identifying the vehicle.

18. A method of controlling of a vehicle key fob via a mobile device, the method comprising:

receiving information regarding a layout of a plurality of buttons of a key fob of a vehicle;

receiving a signal from a mobile device containing information related to a desired function of a vehicle;

selecting one of a plurality of actuators for actuation of one of the plurality of buttons of the key fob, wherein the selecting is based on the layout of the plurality of buttons and the information related to the desired function of the vehicle;

receiving a second signal from the mobile device containing information related to a second desired function of the vehicle; and selecting a second of the plurality of actuators for actuation of a second of the buttons of the key fob based on the layout of the plurality of buttons and the information related to the second desired function of the vehicle.

19. The method of claim 18, further comprising:

receiving information regarding a second layout of a second plurality of buttons of a second key fob of a second vehicle;

receiving a second signal from the mobile device containing information related to the desired function of a vehicle; and selecting a second of the plurality of actuators for actuation of one of the buttons of the second key fob, wherein the selecting is based on the layout of the second plurality of buttons and the information related to the desired function of the vehicle.

20. The method of claim 19, wherein the information regarding the layout of the plurality of buttons is received from the mobile device.

* * * * *